United States Patent [19]

Morrison

[11] 4,268,776

[45] May 19, 1981

[54] CATHODE CUP HAVING SUPPORT FLANGES SLOPED SYMMETRICALLY IN OPPOSING AXIAL DIRECTIONS

[75] Inventor: Raymond C. Morrison, Scituate, Mass.

[73] Assignee: Raytheon Company, Lexington, Mass.

[21] Appl. No.: 12,773

[22] Filed: Feb. 16, 1979

[51] Int. Cl.[3] ..... H01J 29/04; H01J 29/48

[52] U.S. Cl. ..... 313/446; 313/451

[58] Field of Search ..... 313/458, 446

[56] References Cited

U.S. PATENT DOCUMENTS 3,087,082 4/1963 Osborne et al. ..... 313/446 X 3,249,790 5/1966 Schaefer ..... 313/446 X 3,333,138 7/1967 Szegho ..... 313/446 X 4,106,840 8/1978 Tyson ..... 313/318

*Primary Examiner*—Robert Segal

*Attorney, Agent, or Firm*—John T. Meaney; Joseph D. Pannone

[57] ABSTRACT

An electron discharge device including an evacuated envelope having therein an indirectly heated cathode comprised of a metallic cathode cup having a cylindrical wall provided with an outwardly extended pair of opposing axially sloped flanges which contactingly engage respective opposing bevelled surfaces of a dielectric support ring encircling the wall and having an inner periphery radially spaced therefrom.

6 Claims, 4 Drawing Figures

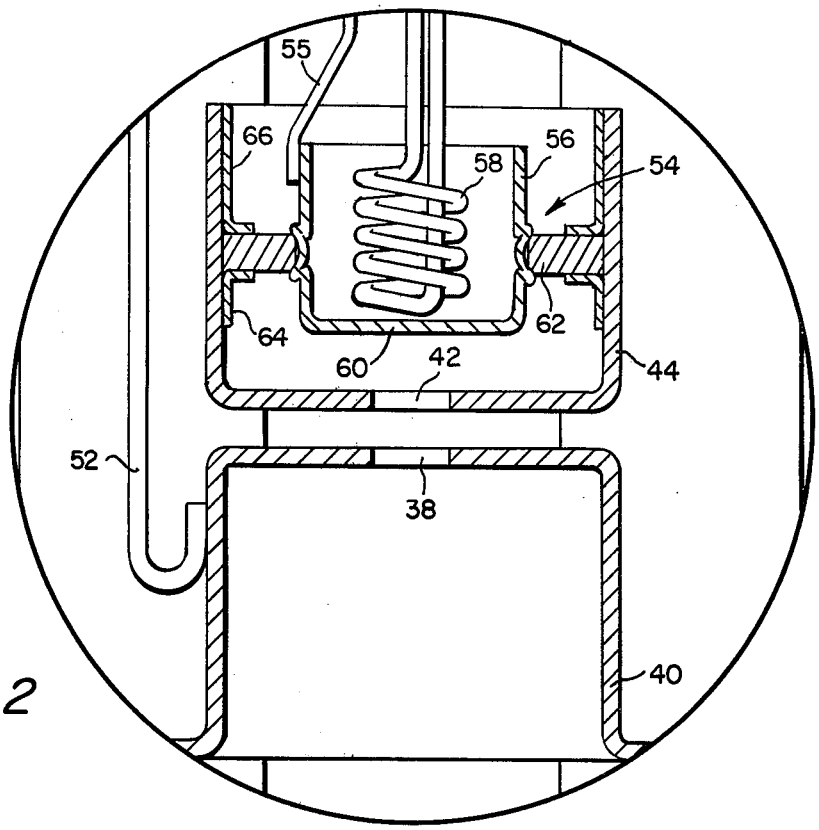
FIG. 2
FIG. 3
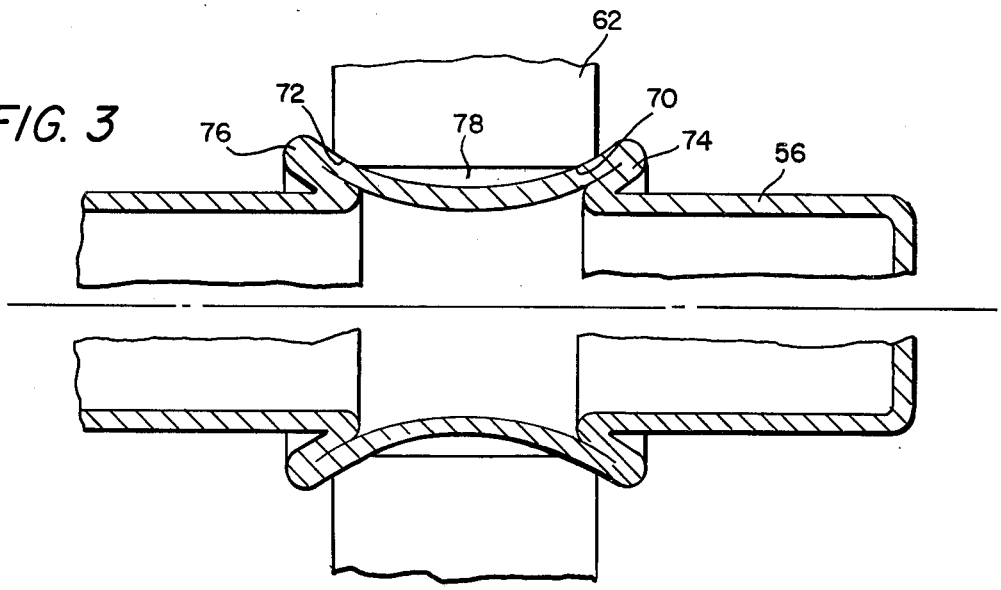

CATHODE CUP HAVING SUPPORT FLANGES SLOPED SYMMETRICALLY IN OPPOSING AXIAL DIRECTIONS

BACKGROUND OF THE INVENTION

1. Field of the Invention

This invention relates generally to electron discharge devices and is concerned more particularly with a cathode support structure for such devices.

2. Discussion of the Prior Art

An electron discharge device generally comprises an evacuated envelope having therein an electron emitting cathode disposed to beam electrons toward a spaced anode collector electrode. The cathode may be of the indirectly heated type including a cathode cup having an electrically heated filament extended insulatingly into the open end thereof. The cathode cup usually is made of suitable metallic material, such as nickel, for example, and has a closed end provided with an exterior coating of low work function material which emits electrons copiously when heated. The cylindrical wall of the cup may be provided with a circumferential pair of axially spaced ripples which extend radially outward of the cup. Disposed between the ripples may be an inner peripheral portion of a closely encircling support ring which is made of suitable dielectric material, such as ceramic, for example.

When the ripples are formed in the cylindrical wall of the cup, they bear tightly against respective opposing flat surfaces of the encircling support ring, thereby fixing the cup in predetermined spaced relationship with respect to the anode collector electrode. However, when the cathode cup is heated to an unusually high temperature, such as during "hot-shot" treatment, for example, the metallic material of the cup expands thermally at a faster rate than the closely encircling support ring. As a result, the cylindrical wall of the cathode cup is pressed annularly against the inner periphery of the support ring and receives a resulting circumferential crimp which extends radially inward of the cup. Accordingly, when the cathode is cooled to room temperature, the circumferential crimp is permanently set in the cylindrical wall of the cathode cup; and the inner peripheral portion of the support ring is no longer locked tightly between the circumferential ripples in the cylindrical wall of the cup. Consequently, when the tube is operated under vibrational or shock conditions, the loosened cathode cup is permitted to move relative to the other elements of the tube. Thus, the intensity of electrons beamed to the collector electrode may vary erratically and may effect the accuracy of an informational signal being amplified or displayed by the tube.

Therefore, it is advantageous and desirable to provide an electron discharge device with a cathode support structure which will maintain the cathode in fixed positional relationship with other electrodes of the device.

SUMMARY OF THE INVENTION

Accordingly, this invention provides an electron discharge device including an evacuated envelope having therein an indirectly heated cathode disposed to beam electrons toward a spaced anode electrode. The cathode preferably comprises a metallic cup having an open end wherein an electrically heated filament extends, and an opposing closed end provided with an exterior coating of electron emissive material. Between its ends, the cathode has a cylindrical wall supporting an outwardly extended pair of axially sloped flanges which are disposed to provide therebetween channel means having opposing wall portions extending transversely with respect to the axial centerline of the cathode.

The flanges preferably are annular and disposed at respective opposing acute angles of inclination to the axial centerline of the cathode for providing respective wall portions of a continuous channel which extends arcuately with the curvature of the supporting cylindrical wall. Thus, the annular flanges may be symmetrically sloped in opposing axial directions to comprise outwardly divergent wall portions of a trough-like channel which may be disposed substantially concentrically with the cylindrical wall of the cathode. The flanges may be integrally formed in the material of the cylindrical wall or may comprise outwardly extended portions of respective collars attached to the outer surface of the cylindrical wall.

The axially sloped flanges of the cathode are supportingly engaged by respective similarly sloped surfaces of dielectric support means spaced outwardly from the cylindrical wall of the cathode. The dielectric support means may comprise a rigid member protruding into the cathode channel means and having opposed bevelled surfaces contacting respective sloped flanges, which constitute opposing wall portions of the channel means. Since the wall portions of the channel means extend transversely with respect to the axial centerline of the cathode, the bevelled surfaces of the dielectric member support the cathode both axially and radially within the tube envelope.

The dielectric member preferably comprises a support ring encircling the cylindrical wall of the cathode and having an inner peripheral portion spaced radially therefrom. The inner peripheral portion of the ring is disposed in a continuous channel formed by a pair of annular flanges which diverge outwardly of the cathode. The inner peripheral portion of the ring has opposed bevelled surfaces which preferably are annular and provide the ring aperture with respective frustoconical end portions.

The opposed bevelled surfaces are disposed in contact with respective outwardly divergent flanges of the cathode, thereby supporting it both axially and radially in a vibration resistant manner. Each of the bevelled surfaces may conform substantially to the respective angle of inclination of the contacted flange and lie in slidable contact therewith. Alternatively, the bevelled surfaces of the ring may be disposed with respect to the axial centerline of the cathode at lesser acute angles of inclination than the respective adjacent flanges so as to ensure pressure contact with the adjacent flanges. Thus, in either instance, the inner peripheral portion of the ring is locked between the pair of outwardly divergent cathode flanges.

In operation, when the cathode is heated to an unusually high temperature, such as during "hot-shot" treatment, for example, the metallic material of the cathode expands thermally at a faster rate, both axially and radially, than the dielectric material of the support ring. However, since the inner peripheral portion of the ring is radially spaced from the cylindrical wall of the cathode, the metallic material of the cylindrical wall is enabled to expand freely, both axially and radially, relative to the support ring. As a result, the cathode flanges slide angularly along the respective bevelled surface of the support which continues to maintain supporting contact therewith. When the cathode is cooled, such as returning to room temperature, for example, the cylindrical wall of the cathode contracts, both axially and radially, relative to the support ring. Consequently, the cathode flanges slide angularly in the opposite direction along the adjacent bevelled surfaces of the ring, thereby maintaining supporting contact therewith. In this manner, the cathode may be supported in predetermined spaced relationship with the spaced anode electrode, even while undergoing thermal expansion and contraction, both axially and radially, relative to the encircling support ring of dielectric material.

BRIEF DESCRIPTION OF THE DRAWINGS

For a better understanding of this invention, reference is made in the following more detailed description to the accompanying drawings wherein:

FIG. 2 is an enlarged fragmentary view of the cathode support structure shown in FIG. 1;

FIG. 3 is a schematic view of the cathode structure of this invention shown in FIGS. 1 and 2.

DESCRIPTION OF THE PREFERRED EMBODIMENTS

Figure 1:
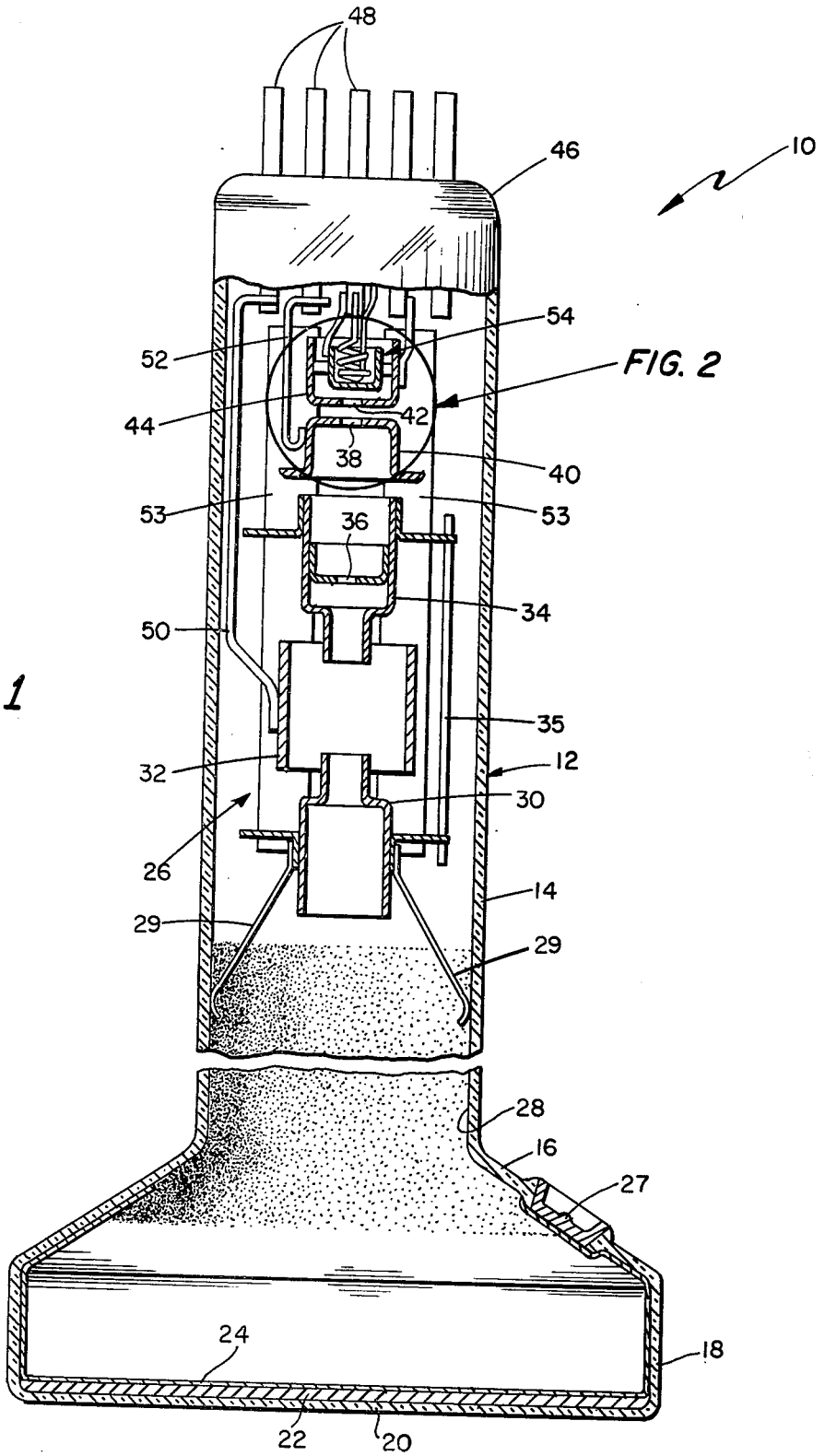
FIG. 1 is an axial sectional view of a cathode ray type tube embodying the cathode support structure of this invention.

Referring to the drawings wherein like characters of reference designate like parts, there is shown in FIG. 1 a cathode ray type tube 10, such as a display tube, for example, having an evacuated envelope 12 which may be made of dielectric vitreous material, such as glass, for example. Envelope 12 preferably has a neck end portion 14 integrally joined through an intermediate flared portion 16 to an opposing, larger diameter end portion 18 of the envelope. The larger diameter end portion 18 is sealed by a transversely disposed faceplate 20. Faceplate 20 has disposed on its inner surface an anode collector electrode comprising an imaging screen fluorescent layer 22 and an overlying layer 24 of electrically conductive material, such as aluminum, for example. The layer 22 fluoresces locally when successive discrete areas thereof are scanned, in a well-known manner, by a high energy electron beam emanating from an electron gun 26 axially disposed in the neck end portion 14 of envelope 12.

The layer 24 extends axially and annularly along the larger diameter end portion 18 and onto the intermediate flared portion 16 of envelope 12, where it is electrically connected to an anode terminal button 27 sealed into the wall of the envelope. The layer 24 and the terminal button 27 are electrically connected to a layer 28 of electrically conductive material, such as graphite, for example, deposited by well-known means on the inner surface of envelope 12. Layer 28 extends axially and annularly along the intermediate flared portion 16 and into the neck end portion 14 of envelope 12. Within neck end portion 14, the layer 28 is electrically contacted by terminal end portions of respective resilient arms 29 which extend outwardly from a tubular exit electrode 30 of gun 26.

Electrode 30 has a reduced diameter end portion insulatingly encircled by an adjacent end portion of a focussing sleeve electrode 32, which has an opposing end portion insulatingly encircling a reduced diameter end portion of another tubular electrode 34. The tubular electrodes, 30 and 34, respectively, and the interposed focussing sleeve electrode 32 constitute a well-known Einsel lense. Electrodes 34 and 30 comprise respective first and second electron accelerating electrodes which are electrically connected to one another through a conductor 35. The first electron accelerating electrode 34 may be provided with a transversely disposed partition having centrally disposed therein an electron beam limiting aperture 36. Aperture 36 is axially aligned with an aperture 38 centrally disposed in a closed end of a second grid-cup electrode 40. The aperture 38 is axially aligned with an aperture 42 centrally disposed in an adjacent closed end of a first grid cup electrode 44. An opposing open end of grid cup electrode 44 is disposed adjacent an axially disposed stem press 46 which seals closed the neck end portion 14 of envelope 12. Centrally disposed in stem press 46 may be an exhaust tubulation (not shown) which is sealed-off when evacuation of envelope 12 is completed.

Stem press 46 has extending hermetically through it a circular array of spaced terminal pins 48 which provide means for making external electrical connections to the electrodes of gun 26. For example, respective pins 48 of the array may be electrically connected to the focussing sleeve electrode 32 and the second grid cup electrode 40 through conductors, 50 and 52, respectively. The Einsel lense electrodes, 30, 32, and 34, respectively, and the grid cup electrodes, 40 and 44 constitute the beam forming electrodes of gun 26. These electrodes may be maintained insulatingly in axial alignment with one another by attachment, in a well-known manner, to an encircling array of spaced dielectric posts 53 which extend axially within neck end portion 12. The resulting sub-assembly of beam forming electrodes may be supported in neck end portion 14 by attaching the first grid cup electrode 44 to three triangularly spaced terminal pins 48, which also provide means for making external electrical connections to the electrode 44.

As shown more clearly in FIG. 2, within grid cup electrode 44, there is insulatingly supported an electron producing means comprising an indirectly heated cathode 54. Cathode 54 includes an axially disposed cup 56 having an open end disposed adjacent the open end of grid cup electrode 44, and having axially extended within it an electrically insulated filament 58. The filament 58 may comprise a helically wound wire having terminal end portions electrically connected to respective terminal pins 48, and coated with dielectric material, such as ceramic, for example. Cathode cup 56 is made of metallic material, such as nickel alloy, for example, and preferably is electrically connected through a conductor 55 to a respective terminal pin 48. The cathode cup 56 has a closed end provided with an exterior coating 60 of electron emissive material, such as oxides of barium and strontium, for example, which is spaced axially from the aperture 42 in the closed end of grid cup electrode 44.

The axially extending wall of cathode cup 56 is encircled by a support ring 62 made of dielectric material, such as ceramic, for example. Ring 62 has an outer peripheral portion disposed between opposing flanged end portions of respective metal brackets 64 and 66 which preferably are annular. The brackets 64 and 66 are attached, as by welding, for example, to the axially extending inner surface of grid cup electrode 44, and position the ring 62 axially with respect to the aperture 42 in the closed end of electrode 44.

As shown more clearly in FIG. 3, the inner peripheral portion of ring 62 is radially spaced from cathode cup 56 and has opposing bevelled surfaces, 70 and 72, respectively, which provide the ring aperture with respective frusto-conical end portions. The bevelled surfaces 70 and 72 are disposed in interfacing contact engagement with respective axially sloped flanges 74 and 76 which extend outwardly of the cathode cup 56. The flanges 74 and 76 preferably are annular and sloped in opposed axial directions with respect to the axial centerline of cathode 54 to form respective opposing acute angles of inclination therewith. Also, the flanges 74 and 76 diverge outwardly of the cathode cup 56 and preferably are axially spaced apart to constitute opposing sloped wall portions of an interposed trough-like channel 78 wherein the inner peripheral portion of support ring 62 is disposed.

The flanges 74 and 76 may be formed integrally in the axially extending wall of cathode cup 56 by conventional means, such as upsetting the material of the axially extending wall by means of a mandrel and cooperating die, for example. As a result, each of the respective flanges 74 and 76 may comprise an annularly pressed fold extending outwardly of cathode cup 56 and sloped in the axial direction at a desired acute angle with the axial centerline thereof. The respective flanges 70 and 72 may be disposed symmetrically relative to the centerline of interposed channel 78 which may have a concave curvature with respect to the radially spaced inner periphery of ring 62. Also, each of the flanges and the respective adjacent bevelled surfaces may be disposed at substantially equal acute angles of inclination with respect to the axial centerline of cathode cup 56, such that the flanges 74 and 76 lie in substantially parallel contacting engagement with the adjacent bevelled surfaces, 70 and 72, respectively. Alternatively, each of the flanges may be disposed at slightly greater acute angles of inclination with respect to the axial centerline of cathode cup 44 than the adjacent bevelled surfaces to ensure that the flanges 74 and 76 pressingly engage the adjacent bevelled surfaces, 70 and 72, respectively.

Accordingly, due to the opposing bevelled surfaces 70 and 72 being locked into contacting engagement with the opposing axially sloped surfaces of flanges 74 and 76, respectively, the cathode cup 56 is supported both axially and radially in a vibration resistant manner with respect to the aperture 42 in the closed end of grid cup electrode 44. When the cathode 24 is heated to an exceptionally high temperature, such as during "hot-shot" treatment to activate the electron emissive layer 60 during processing of tube 10, for example, the metallic material of cathode cup 56 elongates thermally and expands radially at a faster rate than the dielectric material of support ring 62. As a result, the flanges 74 and 76 slide angularly outward along the adjacent bevelled surfaces 70 and 72, respectively, while maintaining contacting engagement therewith. Thus, the bevelled surfaces 70 and 72 of ring 62 continue to support the cathode cup 56 both axially and radially in a vibration resistant manner with respect to the aperture 42. Due to the annular space between the inner periphery of ring 62 and the axially extending wall portion of cathode cup 56 the annular crimping found in tubes of the prior art after "hot-shot" treatment is avoided.

Similarly, when the cathode 24 subsequently is allowed to cool to a considerably lower temperature, the metallic material of cathode cup 56 contracts both axially and radially at a faster rate than the dielectric material of support ring 62. Consequently, the flanges 74 and 76 slide angularly inward along the adjacent bevelled surfaces 70 and 72, respectively, while maintaining contacting engagement therewith. As a result, the bevelled surfaces 70 and 72 of ring 62 continue to support the cathode cup 56 both axially and radially in a vibration resistant manner with respect to the aperture 42 even though the annular space between the axially extending wall of cathode cup 44 and the inner periphery of ring 62 may increase during thermal contraction. Thus, the problem of the layer 60 moving relative to the aperture 42 after "hot-shot" treatment and thereby varying the intensity of the electron beam reaching the anode collector electrode in prior art tubes is avoided with the cathode support structure of this invention.

Figure 4:
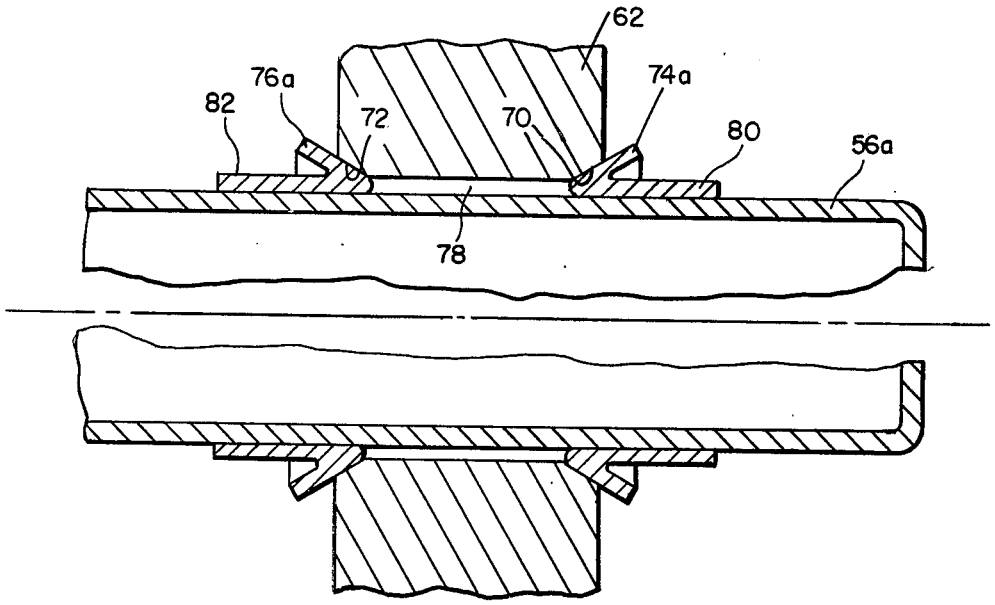
FIG. 4 is an alternative embodiment of the cathode structure shown in FIG. 3.

In FIG. 4 there is shown an alternative embodiment which is similar to the embodiment shown in FIG. 3 except the flanges 74 and 76 are not formed integrally in the axially extending wall of cathode cup 56. Rather, a cathode cup 56*a* may have fixedly attached, as by welding, for example, to the axially extending outer surface thereof a pair of axially extending collars 80 and 82, respectively. The collars 80 and 82 having respective outwardly extending flanges 74*a* and 76*a* which are disposed and function in a manner similar to that described in connection with the flanges 74 and 76, respectively. Accordingly, the cathode cup 56*a* may be used in place of the cathode cup 56 shown in FIG. 3 for the practicing of this invention.

Thus, it may be seen that the respective flanges 80 and 82 need not be spaced axially apart, but may be disposed in any manner, such as annularly contiguous, for example, to form the trough-like channel 78. Also the flanges 80 and 82, respectively, and the adjacent bevelled surfaces 70 and 72, respectively, may be disposed at acute angles of inclination to the axial centerline of cathode cup 56*a* that corresponding portions of the flanges and the adjacent bevelled surfaces undergo substantially similar thermal changes to remain adjacent one another during thermal expansion and contraction. Furthermore, the described means for supporting cathode cup 56 may be suitable for supporting other electrodes of gun 26, such as tubular electrodes 30 and 34 within sleeve electrode 32, for example. However, the described support means is particularly well adapted for supporting cathode cup 56 by dielectric encircling means due to the more acute thermal expansion and contraction problems involved.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted in an illustrative rather than in a restrictive sense.

What is claimed is:

1. An electron discharge device comprising:

an envelope;

electrode means disposed within the envelope for producing a flow of electrons therein and including a cylindrical cathode having an axially extended outer surface provided with an outwardly extended pair of opposing mutually divergent flanges to form respective opposing sloped wall portions of an interposed channel, each flange being sloped axially at a respective acute angle of inclination relative to the surface; and support means spaced outwardly from the axially extended outer surface of the cathode and including a ring-shaped dielectric member having an inner peripheral portion extended radially into the channel and provided with opposing bevelled surfaces which are disposed in slidable contacting engagement with the respective flanges for insulatingly supporting the cathode in a predetermined position within the envelope.

2. An electron discharge device as set forth in claim 1 wherein the cathode comprises a cathode cup having disposed therein an electrically heated filament and having a closed end provided with an exterior coating of electron emissive material.

3. An electron discharge device as set forth in claim 2 wherein the electrode means includes an electron gun series of beam forming electrodes disposed in axial alignment with the closed end of the cathode cup.

4. An electron discharge device as set forth in claim 3 wherein one of the beam forming electrodes comprises an electrically conductive cylinder having an axially extending wall encircling the cathode and supporting an outer peripheral portion of the dielectic ring.

5. An electron discharge device as set forth in claim 4 wherein said one of the beam forming electrodes comprises a grid cup having a closed end provided with an aperture which id disposed adjacent the electron emissive coating on the closed end of the cathode cup.

6. An electron discharge device as set forth in claim 5 wherein the electrode means includes an anode target electrode disposed in axially spaced alignment with the beam forming electrodes of the electron gun.

* * * * *